343-754 SR
2/16/82 XR 4,316,195

United States Patent [19] [11] 4,316,195
Steffek et al. [45] Feb. 16, 1982

[54] ROTATING DUAL FREQUENCY RANGE ANTENNA SYSTEM

[75] Inventors: Leonard J. Steffek, Centereach; Stanley Drake, Blue Point, both of N.Y.

[73] Assignee: The United States of America as represented by the Secretary of the Army, Washington, D.C.

[21] Appl. No.: 188,798

[22] Filed: Sep. 19, 1980

[51] Int. Cl.[3] ..... H01Q 3/00
[52] U.S. Cl. ..... 343/758; 343/872; 343/754; 343/755; 343/840
[58] Field of Search ..... 343/759, 758, 872, 754, 343/755, 753, 835, 836, 840

[56] References Cited

U.S. PATENT DOCUMENTS 2,942,264 6/1960 Ratkevick ..... 343/836
3,277,490 10/1966 Williams ..... 343/759

*Primary Examiner*—David K. Moore
*Attorney, Agent, or Firm*—Nathan Edelberg; Sheldon Kanars; Jeremiah G. Murray

[57] ABSTRACT

Disclosed is an antenna system designed to operate in two frequency ranges simultaneously, namely S-band (1660 to 1700 MHz) and X-band (8500 to 9600 MHz). The system comprises two separate antennas which are conically scanned and share a common parabolic reflector within a radome. The S-band antenna is adapted for passive angle tracking and reception of radiosonde data by means of a balun fed dipole feed system which includes an offset hemispherical reflector which is rotated by a scan motor to provide conical scanning. The X-band antenna comprises an active feed system which includes a stationary feedhorn and a tapered dielectric lens which is coupled to the S-band hemispherical reflector and is rotated therewith about an axis through the vertex of the parabolic reflector. The tapered lens tilts the constant phase front of the X-band radiation pattern thereby producing a displaced phase center near the focus of the antenna to implement its respective conical scanning operation.

15 Claims, 7 Drawing Figures

ROTATING DUAL FREQUENCY RANGE ANTENNA SYSTEM

The invention described herein may be manufactured and used by or for the Government for governmental purposes without the payment of any royalties thereon or therefor.

BACKGROUND OF THE INVENTION

This invention relates generally to a scanning type antenna system and more particularly to a conical scan antenna system which includes two separate feed assemblies for simultaneously operating in two different frequency ranges.

Previously, conical scan of a radar signal pattern, for example, has been accomplished by rotating or nutating the entire feed. A need was recognized for eliminating the rotating feed where broadband coverage utilizing multiple polarizations was required. In addition to the utilization of rotating prisms, parasitic elements that rotate about a stationary active feed have been utilized. An example of the latter type system is disclosed in U.S. Pat. No. 3,277,490, "Broadband Conical Scan Feed For Parabolic Antennas" issued to L. Williams on Oct. 4, 1966.

Accordingly, it is an object of the present invention to provide a new and improved conical scanning antenna system.

Another object of the present invention is to provide a new and improved conical scanning antenna system which includes both active and passive feeds for operating in two frequency bands simultaneously.

Still another object of the present invention is to provide a new and improved conical scanning antenna system wherein two separate feed assemblies utilize a common antenna element.

SUMMARY

Briefly, these and other objects are provided in accordance with an antenna configuration which comprises a passive S-band dipole feed and an active X-band feed mounted in face-to-face relationship along an axis through the vertex of a common parabolic reflector which faces a radome. Conical scanning is provided by means of a hemispherical reflector which is axially offset from the S-band dipole feed and a tapered dielectric lens axially located around the X-band feedhorn. The hemispherical reflector and the dielectric lens are attached together and rotated about the axis through the vertex by means of a single scan motor which additionally drives a reference generator whose output is utilized by a remote S-band and X-band receiver. In order to offset the degrading effects of the X-band feed structure on S-band antenna performance, an aperture plate is located intermediate the hemispherical reflector and the dielectric lens. The X-band feedhorn moreover is adapted to operate with vertically, horizontally or circularly polarized RF pulses through the inclusion of variable polarizer coupled to the feedhorn.

DESCRIPTION OF THE DRAWINGS

The present invention will become readily apparent when the following description is considered in connection with the accompanying drawings, in which.

DESCRIPTION OF THE PREFERRED EMBODIMENT

Figure 1:
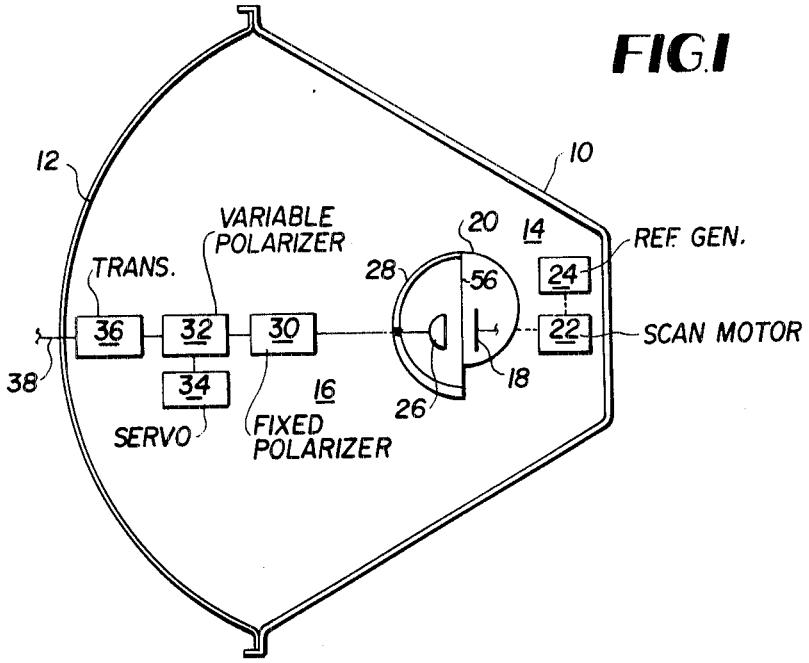
FIG. 1 is a simplified schematic drawing illustrative of the preferred embodiment of the subject invention.

Referring now to the drawings wherein like reference numerals refer to like parts throughout, the invention in its simplest form is shown schematically in FIG. 1 wherein reference numeral 10 designates a radome clamped to a parabolic reflector 12. This parabolic reflector is used by two separate feed assemblies 14 and 16, which are adapted to operate respectively at S-band (1660–1700 MHz) and X-band (8500–9600 MHz).

The S-band feed includes a passive stationary balun fed dipole antenna element 18 located near the vertex of the parabolic reflector 12. The dipole element 18 lies along the central axis which passes through the vertex. A hemispherical reflector 20 is located behind the dipole element 18 facing the parabolic reflector 12 and is offset from the central axis. The eccentric reflector 20 is rotated by means of an electrical scan motor 22 which is also coupled to an electrical reference signal generator 24 which is utilized by an S-band and X-band receiver, not shown. The X-band feed includes an active stationary feedhorn 26 located along the central axis around which is located a tapered dielectric lens 28. The feedhorn 26 couples to a wave polarizer consisting of fixed polarizer section 30 and a variable (rotatable) polarizer section 32, the latter being selectively rotated by a servo device 34. The variable polarizer section 32 couples to a waveguide transition section 36 which in turn is coupled to an X-band radar system.

Figure 2:
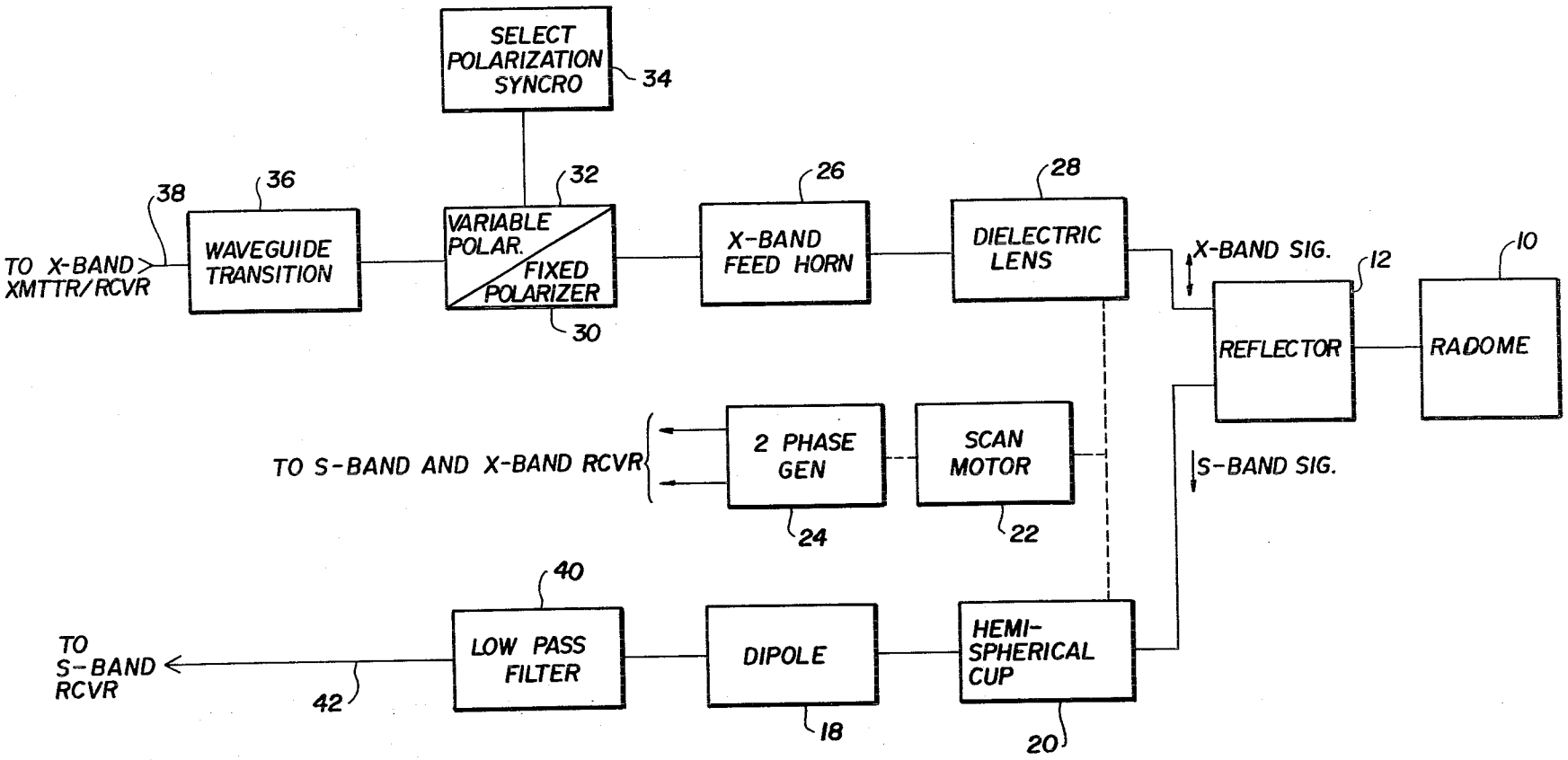
FIG. 2 is a block diagram illustrative of the elements utilized in implementing the embodiment shown in FIG. 1.

While FIG. 1 is intended to basically illustrate the physical interrelationship of the components located within the confines of the radome 10 and the parabolic reflector 12, FIG. 2 is an electrical-mechanical block diagram of the system. It is also intended to further illustrate the dual nature of the subject invention. The upper portion of FIG. 2 shows that the elements from the waveguide transition 36 to the dielectric lens 28 is intended to operate with an X-band transmitter/-receiver, not shown, coupled to a waveguide transmission line 38. The lower portion of the block diagram illustrates that the dipole element 18 operates simply as a receiver of S-band signals and is adapted to be coupled back to an S-band receiver, not shown, through a low pass filter element 40 and a transmission line 42. It is also significant to note that the scan motor 22 is mechanically coupled not only to the two phase generator 24, but also to the X-band dielectric lens 28 and the S-band hemispherical reflector 20.

Figure 3:
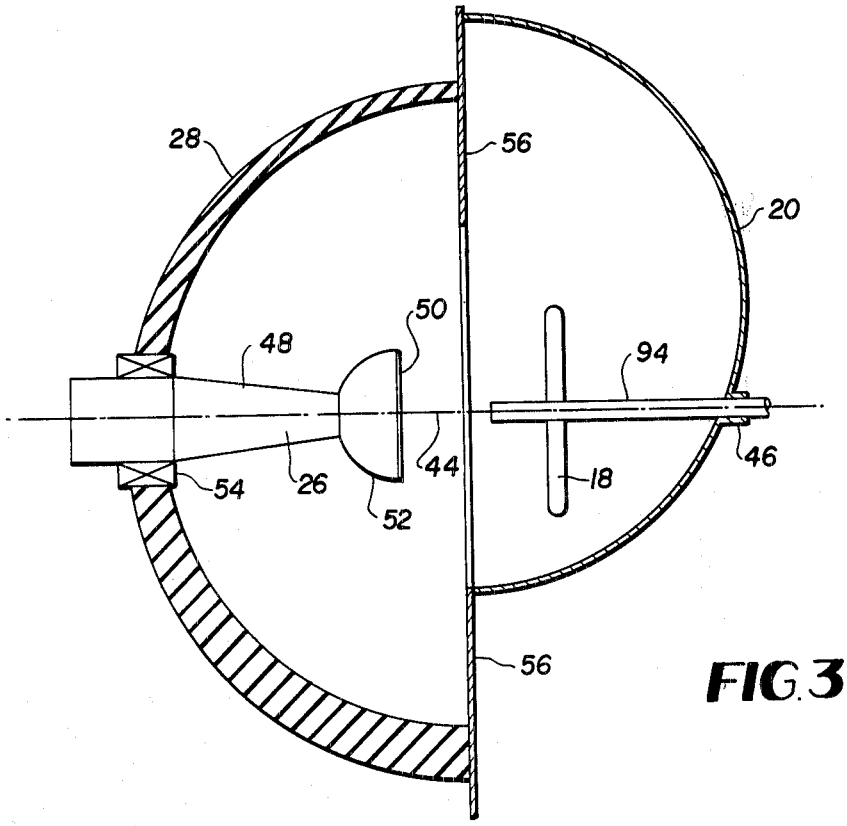
FIG. 3 is an exploded view illustrative of the passive S-band and active X-band feeds and their respective hemispherical reflector and dielectric lens sub-assemblies.

Referring now to FIG. 3, this drawing is intended to further illustrate the face-to-face relationship of the antenna feeds 18 and 26. These elements are shown positioned along an axis 44 which comprises the central axis through the vertex of the parabolic reflector 12 shown in FIG. 1. The stationary S-band dipole feed element 18 furthermore passes through a hub 46 of the hemispherical reflector 28 which is adapted to freely rotate about the axis 44 in offset relationship with the dipole feed element 18. As a consequence, the secondary pattern thereof is conically scanned as it faces the parabolic reflector 12 which comprises the primary receptor of incident S-band radiation from an external RF source.

The X-band feed element 26 consists in a tapered cylindrical waveguide 48 coupled to a splash plate 50. The splash plate operates in a well known manner to reflect RF power from the waveguide 48 to the parabolic reflector 12 through the dielectric lens 28. The cup shaped element 52 between the waveguide 48 and the splash plate 50 comprises a small lens which puts the feedhorn phase center at the focus of the antenna. As already stated, the tapered dielectric lens 28 rotates about the axis 44; however, it is centrally located therewith and is adapted to rotate about the feedhorn element 26 by means of a bearing sub-assembly 54. The dielectric lens 28 is adapted to provide a conical scanning of the X-band energy by tilting the constant phase front of the feedhorn radiation pattern, thereby producing a displaced phase center near the focus of the antenna.

The tapered lens 28 is attached to the front edge of the eccentric hemispherical reflector 20 by means of an aperture plate 56 which is included to control the degrading effects of the X-band feed structure on the antenna performance of the S-band dipole element 18. The aperture plate 56 contains a "D" shaped aperture hole which is offset from the antenna boresight axis, thereby providing a better control of the illumination received from the parabolic reflector 12.

Figure 4:
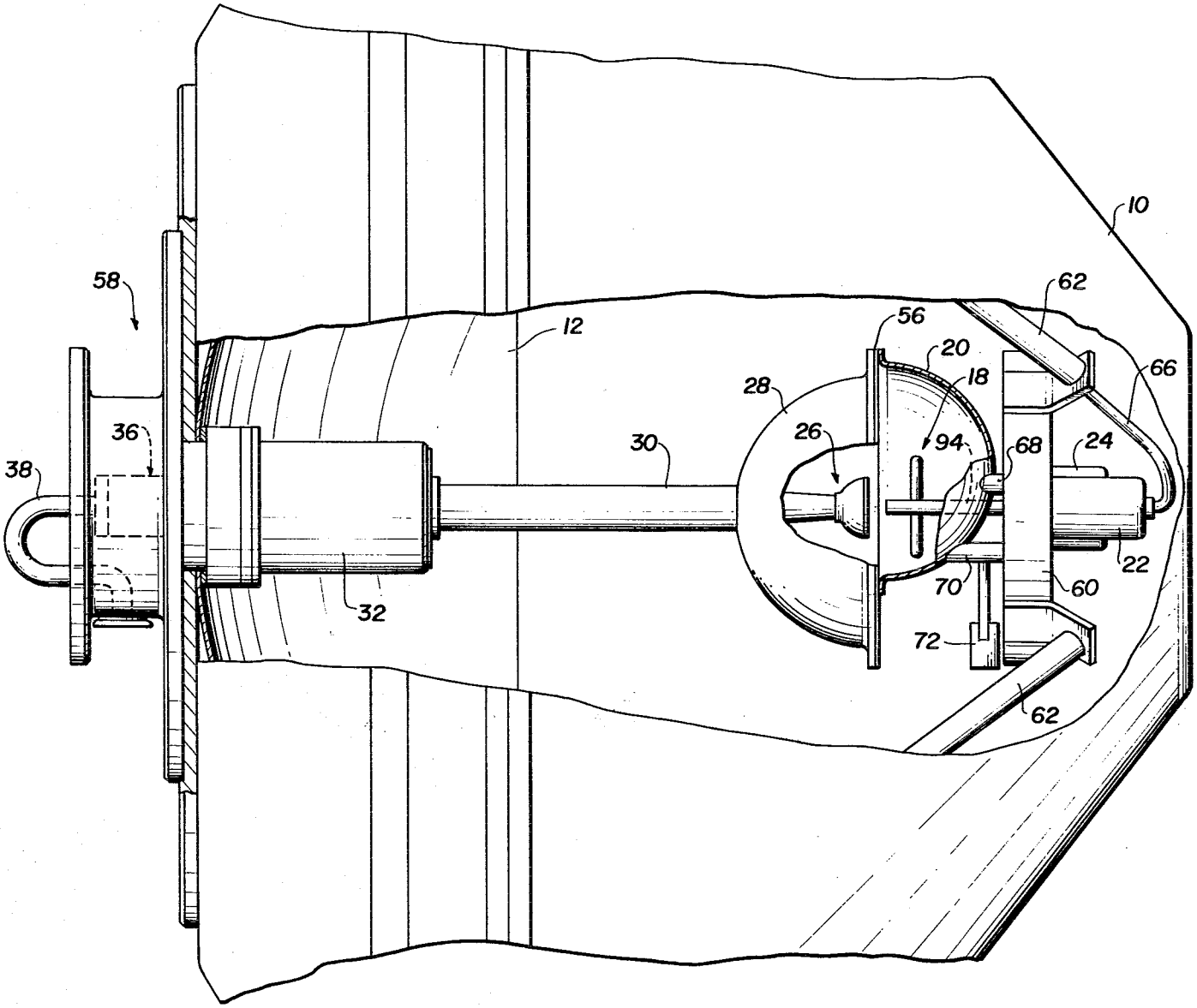
FIG. 4 is a partial cut-away view of the mechanical features of the embodiment shown in FIG. 1.

Referring now to FIG. 4, the structural features shown are intended to illustrate the manner in which the two antenna assemblies are mounted within the radome 10. As FIG. 4 indicates, the X-band waveguide 38 and transition section 36 goes through a mounting structure 58 to which is secured parabolic reflector 12 and radome 10. This arrangement is typical of an X-band radar feed located on the central axis through which the vertex of parabolic reflector lies. In order to achieve the arrangement of the antenna elements as shown in FIG. 3, the S-band balun fed dipole feed is held in position by means of a support structure consisting of a frame structure 60 which is held in place by means of four support struts 62 typically extending back to and attaching to the parabolic reflector 12. The scan motor 22 and the reference generator 24 are mounted on the frame 60 with the electrical wiring therefrom being coupled away from and out of the reflector 12 via one of the struts 62 as evidenced by reference numeral 66. The scan motor 22 is coupled to the S-band hemispherical reflector 20 by means of projecting members 68 and 70 which attach to a gear assembly shown in FIG. 7 and which will be referred to subsequently. Inasmuch as the reflector 20 is eccentrically rotated, a counterbalance weight 72 is attached to the member 70.

Figure 5:
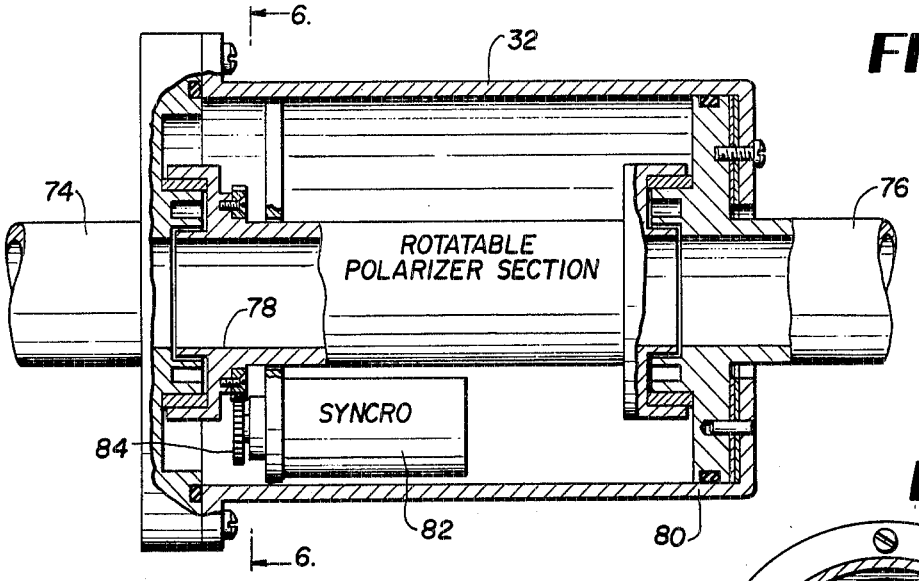
FIG. 5 is a longitudinal cut-away view of the rotatable polarizer section utilized in connection with the X-band feed sub-assembly shown in FIG. 4.
Figure 6:
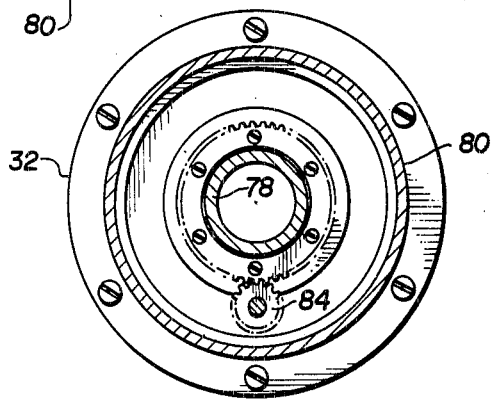
FIG. 6 is a sectional view of FIG. 5 taken along the lines 6—6 thereof.

As noted above, the X-band feedhorn 26 is fed through a wave polarizer consisting of a fixed polarizer section 30 and a variable polarizer section 32 and is adapted to furnish either vertically, horizontally or circularly polarized energy to the feedhorn 26. The details of the variable polarizer section 32 is illustrated in FIG. 5. Referring now to FIGS. 5 and 6, reference numerals 74 and 76 denote circular waveguide sections which couple to a section of rotatable waveguide 78 contained within a housing structure 80. The rotatable section 80 is adapted to be rotated in accordance with a remotely controlled syncro device 82 located within the housing 80 and coupled to the rotatable section 78 through gearing means 84. The two polarizer sections 30 and 32 each consist of a modified section of circular waveguide which retards one of the two orthogonal wave components of TE-11 mode propagation so that they are in phase quadrature at the output of the respective polarizer section. In operation, when the rotatable polarizer section 32 is aligned in one of two extreme positions, it changes linearly polarized waves from the transmitter coupled to the waveguide 38 (FIG. 4) to left or right hand circular polarization. The fixed polarizer section 30 in turn converts the circularly polarized waves to linear vertical or linear horizontal polarization, depending upon the position of the preceding section 32. When the polarizer section 32 is in its central position, it has no effect on the linearly polarized input wave and the fixed polarizer 30 produces circular polarization. Thus depending upon the position of the waveguide section 78 as controlled by the syncro 82 which receives signals from a remote source such as the X-band transmitter/receiver section vertical or horizontal linear polarization, or circular polarization of the radiated X-band signals from the feedhorn 26 can be achieved.

Figure 7:
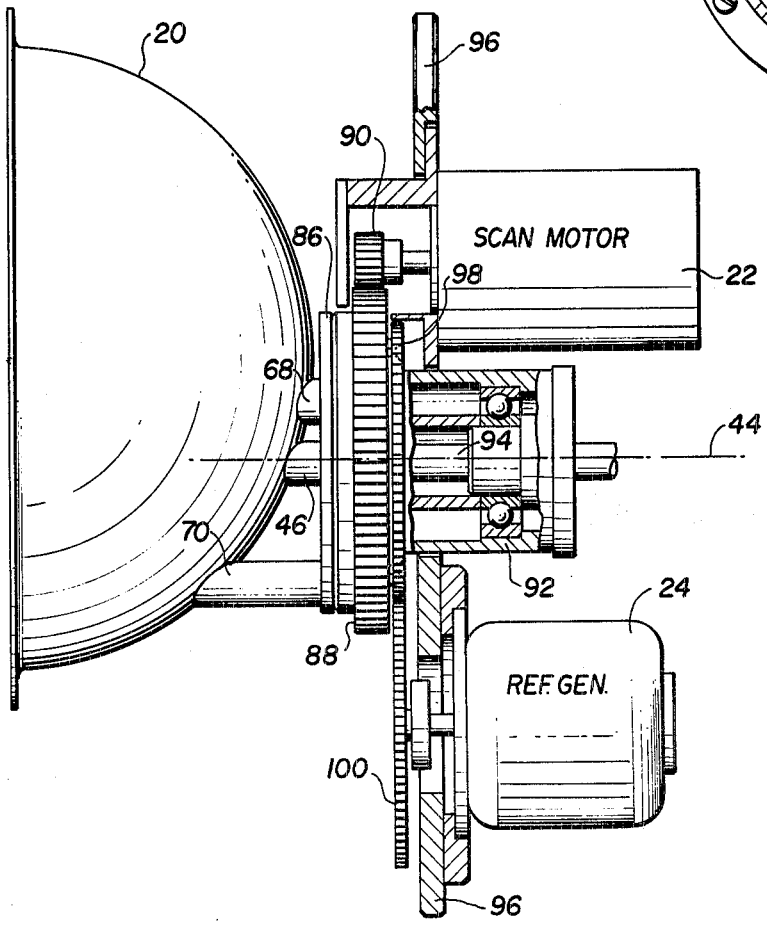
FIG. 7 is a side view partially in section of the S-band sub-assembly which forms part of the subject invention.

In order to more fully understand the structural details of the S-band feed, particularly as it relates to the hemispherical reflector 20 associated with the S-band feed element 18 shown in FIG. 4, reference is now made to FIG. 7. As noted above, the S-band reflector 20 is rotated through operation of the scan motor 22. As shown in the figure, the elements 68 and 70 attach to a base plate 86 which is integral with a circular gear member 88 which meshes with a relatively smaller drive gear 90 secured to the shaft of the scan motor 22. A rotating joint 92 is axially aligned with the gear 88 and is adapted to provide an output for the S-band transmission line 94, which couples to the dipole antenna 18. FIG. 7 also discloses the manner in which the reference generator 24 is coupled to and driven by the scan motor 22. As shown, both the scan motor and the reference generator are secured to a base member 96 but are located on opposite sides of the rotating joint 92. The coupling between the two devices is achieved by means of a gear 98 which is attached to the gear 88, meshing with a gear 100 which is secured to the shaft of the reference generator 24.

The apparatus herein shown and described is adapted to operate, for example, in conjunction with a radiosonde, not shown, which includes an S-band transmitter which transmits signals back to the passive S-band antenna assembly 14 located within the radome. Simultaneously with the reception of the S-band signals, X-band radar signals are transmitted from the X-band antenna assembly 16 for providing ranging information with respect to the radiosonde by tracking a corner reflector attached to the sonde. In one mode of operation, the S-band received signals are utilized in connection with a servo-system for providing angle tracking of the sonde while an alternate mode of operation is one in which X-band angle tracking of the corner reflector is implemented.

While there has been shown and described what is at present considered to be the preferred embodiment of the subject invention, alterations and modifications thereto will readily occur to those skilled in the art. It is desired, therefore, that all alterations, modifications and changes coming within the spirit and scope of the present invention are herein meant to be included.

What is claimed is:

1. A conical scan antenna system simultaneously operable at two different frequencies, comprising, in combination:

a parabolic reflector;

a first stationary feed of first frequency RF signals positioned along an axis through the vertex of said parabolic reflector;

rotatable RF reflector means for said first stationary feed facing said parabolic reflector from behind said first feed and being offset from said axis through said vertex;

a second stationary feed of second frequency RF signals positioned along said axis substantially at the vertex of said parabolic reflector and adjacent said first stationary feed;

rotatable RF lens means for said second stationary feed located intermediate said second feed and said parabolic reflector, facing said RF reflector means and being axially aligned with said axis through said vertex;

means attaching said reflector means to said lens means in face-to-face relationship; and scan drive means coupled to at least one of said rotatable means for rotating both said means about said axis through said vertex to effect conical scanning of both feeds simultaneously.

2. The system as defined by claim 1 wherein said first stationary feed is responsive to a first range of RF signals and wherein said second stationary feed is responsive to a second range of RF signals.

3. The system as defined by claim 2 wherein said first stationary feed is operable at S-band and wherein said second stationary feed is operable at X-band.

4. The system as defined by claim 1 wherein said first feed comprises a passive feed system and wherein said second feed comprises an active feed system.

5. The system as defined by claim 4 wherein said RF reflector means comprises a hemispherically shaped reflector within which said first stationary feed is located.

6. The system as defined by claim 4 wherein said RF lens means comprises a tapered dielectric lens of a generally hemispheric shape whose thickness gradually varies from one edge to the other.

7. The system as defined by claim 1 wherein said first stationary feed comprises a passive dipole feed and wherein said second stationary feed comprises an active feed including a feedhorn consisting of waveguide means and a splash plate which reflects RF power from said waveguide to said parabolic reflector.

8. The system as defined by claim 7 wherein said dipole feed is operable at S-band frequencies and wherein said active feed is operable at X-band frequencies.

9. The system as defined by claim 7 wherein said RF reflector means comprises a hemispherical reflector and wherein said RF lens means comprises a tapered dielectric lens.

10. The system as defined by claim 1 and additionally including reference signal generator means coupled to said scan drive means, said generator means providing signals operable in conjunction with received signals to track an external source of RF signals.

11. The system as defined by claim 1 wherein said second stationary feed comprises an active feed coupled to a source of RF energy and additionally including means intermediate said feed and source for controlling the polarization of the RF energy coupled to said feed.

12. The system as defined by claim 11 wherein said means for controlling the polarization comprises means for selectively providing linearly vertical, horizontal or circular polarized RF energy to said feed.

13. The system as defined by claim 12 wherein said means for controlling the polarization comprises a polarizer section of fixed polarization coupled in series with a polarizer section of variable polarization.

14. The system as defined by claim 13 wherein said active feed comprises a feed of X-band radar signals.

15. The system as defined by claim 14 wherein said first stationary feed comprises a balun fed dipole responsive to externally generated S-band signals directed to said parabolic reflector.

* * * * *